US005377565A

United States Patent [19]

Mangum

[11] Patent Number: 5,377,565

[45] Date of Patent: Jan. 3, 1995

[54] AUTOMATIC OIL FILTER CHANGER

[76] Inventor: Charles E. Mangum, P.O. Box 1028, Elm City, N.C. 27822

[21] Appl. No.: 204,961

[22] Filed: Mar. 2, 1994

[51] Int. Cl.[6] ..... B25B 13/50

[52] U.S. Cl. ..... 81/57.33; 81/57.44; 81/90.3

[58] Field of Search ..... 81/57.33, 57.44, 3.2, 81/57.39, 90.2, 90.3

[56] References Cited

U.S. PATENT DOCUMENTS 5,138,915 8/1992 Doll ..... 81/57.33 X

*Primary Examiner*—D. S. Meislin

[57] ABSTRACT

An automatic oil filter changer for changing the oil filter on a vehicle comprising an elongated handle; a tube for delivering pressure having a first end and a second end, the second end adapted to be coupled to a pressure delivery mechanism; a clamping mechanism coupled to the handle and tube, the clamping mechanism having a closed orientation for crimping the tube for preventing pressure from being delivered through the first end and an opened orientation for allowing pressure to be delivered through the first end; and a head mechanism coupled to the handle and first end of the tube, the head mechanism adapted to receive an oil filter therein, the head mechanism further adapted to receive pressure from the first end of the tube such that when the clamping mechanism is placed in an opened orientation, the head mechanism grips and rotates an oil filter positioned therein, and when the clamping mechanism is placed in a closed orientation, the head mechanism releases its grip of the oil filter.

3 Claims, 4 Drawing Sheets

AUTOMATIC OIL FILTER CHANGER

BACKGROUND OF THE INVENTION

1. Field of the Invention

The present invention relates to a automatic oil filter changer and more particularly pertains to changing the oil filter on a vehicle with a automatic oil filter changer.

2. Description of the Prior Art

The use of oil filter changing devices is known in the prior art. More specifically, oil filter changing devices heretofore devised and utilized for the purpose of changing oil filters on vehicles are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,860,617 to Robbins discloses an oil filter tool. U.S. Pat. No. 4,896,570 to Bourgeois discloses an oil filter wrench apparatus. U.S. Pat. No. 4,916,993 to Siekawitch discloses an adjustable oil filter wrench. U.S. Pat. No. 4,964,330 to Swinney et al. discloses an oil filter accessory. U.S. Pat. No. 5,090,274 to Schaub discloses an oil filter wrench.

While these devices fulfill their respective, particular objective and requirements, the aforementioned patents do not describe a automatic oil filter changer that uses external pressure in a toroidal housing as a mechanism for screwing and unscrewing oil filters from vehicles.

In this respect, the automatic oil filter changer according to the present invention substantially departs from the conventional concepts and designs of the prior art, and in doing so provides an apparatus primarily developed for the purpose of changing the oil filter on a vehicle.

Therefore, it can be appreciated that there exists a continuing need for new and improved automatic oil filter changer which can be used for changing the oil filter on a vehicle. In this regard, the present invention substantially fulfills this need.

SUMMARY OF THE INVENTION

In the view of the foregoing disadvantages inherent in the known types of oil filter changing devices now present in the prior art, the present invention provides an improved automatic oil filter changer. As such, the general purpose of the present invention, which will be described subsequently in greater detail, is to provide a new and improved automatic oil filter changer and method which has all the advantages of the prior art and none of the disadvantages.

To attain this, the present invention essentially comprises, in combination, a rigid and tubular handle having a tip end, a base end, and an intermediate portion extended therebetween, the base end having a grip formed thereon adapted for providing a user a firm hold thereof; a neck having a collar with an upper portion and a lower portion and a spring having one end connected to the lower portion of the collar and the other end connected to the tip end of the handle, the spring allowing angular displacement of the handle relative to the neck; a flexible tube having a first end extended through the handle and neck to project from the upper end of the collar and a second end adapted to be coupled to a compressor, the tube adapted to deliver pneumatic pressure from the compressor through the first end thereof; a flexible and tubular shield disposed around the tube and within the spring of the neck for protecting the tube from being crimped when the handle is angularly displaced relative to the neck; clamping means coupled to the intermediate portion of the handle, the clamping means having a closed orientation for crimping the tube for preventing pneumatic pressure from being delivered through the first end and an opened orientation for allowing pneumatic pressure to be delivered through the first end; and a head adapted to hold, thread, and unthread an oil filter from a vehicle when pneumatically energized, the head further comprising a hollow and toroidal housing having an inner radial extent and an outer radial extent, the outer radial extent coupled to the upper portion of the collar such that the first end of the tube is extended within the housing, the inner radial extent having a first ringed aperture disposed thereon; a ring disposed within the housing having a second ringed aperature disposed thereon; a plurality of spaced sliders disposed and slidable in the second ringed aperature, each slider further having a hole disposed therethrough; a plurality of grippers positioned around and adjacent to the inner radial extent of the housing and projected inwards therefrom to define an opening adapted to hold an oil filter therein; and a plurality of curved vanes, each vane having a base end pivotally coupled to a gripper, an intermediate portion connected to the base end and extending radially outwards therefrom through the first ringed aperature and through a hole on a slider, and a tip end coupled to the intermediate portion remote from the base end and formed with an extended surface adapted for receiving pneumatic pressure circularly directed through the housing from the first end of the tube such that when the clamping means is placed in an opened orientation, the vanes are pivoted radially outward and project the grippers radially inward, whereby allowing the grippers to hold and rotate an oil filter therebetween, thus enabling an oil filter to be unscrewed or unscrewed from a vehicle, and when the clamping means is placed in a closed orientation, the vanes are pivoted radially inward and project the grippers radially outward, whereby allowing the grippers to release an oil filter held therebetween.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved automatic oil filter changer which has all the advantages of the prior art oil filter changing devices and none of the disadvantages.

It is another object of the present invention to provide a new and improved automatic oil filter changer which may be easily and efficiently manufactured and marketed.

It is a further object of the present invention to provide a new and improved automatic oil filter changer which is of durable and reliable construction.

An even further object of the present invention is to provide a new and improved automatic oil filter changer which is susceptible of a low cost of manufacture with regard to both materials and labor, and which accordingly is then susceptible of low prices of sale to the consuming public, thereby making such a automatic oil filter changer economically available to the buying public.

Still yet another object of the present invention is to provide a new and improved automatic oil filter changer which provides in the apparatuses and methods of the prior art some of the advantages thereof, while simultaneously overcoming some of the disadvantages normally associated therewith.

Even still another object of the present invention is to provide a new and improved automatic oil filter changer for changing the oil filter on a vehicle.

Lastly, it is an object of the present invention to provide a new and improved automatic oil filter comprising, an elongated handle; a tube for delivering pressure having a first end and a second end, the second end adapted to be coupled to a pressure delivery mechanism; clamping means coupled to the handle and tube, the clamping means having a closed orientation for crimping the tube for preventing pressure from being delivered through the first end and an opened orientation for allowing pressure to be delivered through the first end; and head means coupled to the handle and first end of the tube, the head means adapted to receive an oil filter therein, the head means further adapted to receive pressure from the first end of the tube such that when the clamping means is placed in an opened orientation, the head means grips and rotates an oil filter positioned therein, and when the clamping means is placed in a closed orientation, the head means releases its grip of the oil filter.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
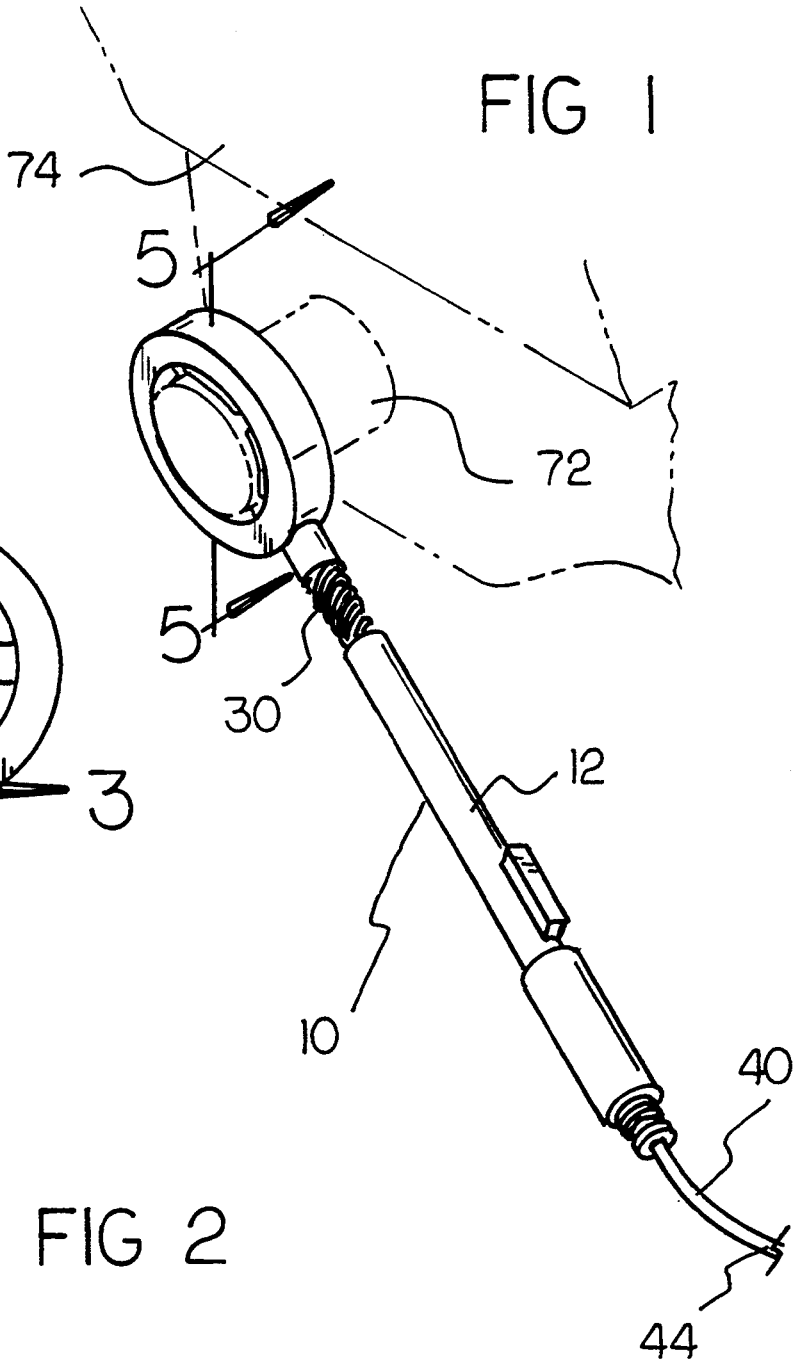
FIG. 1 is a perspective view of the preferred embodiment of the automatic oil filter changer constructed in accordance with the principles of the present invention.
Figure 2:
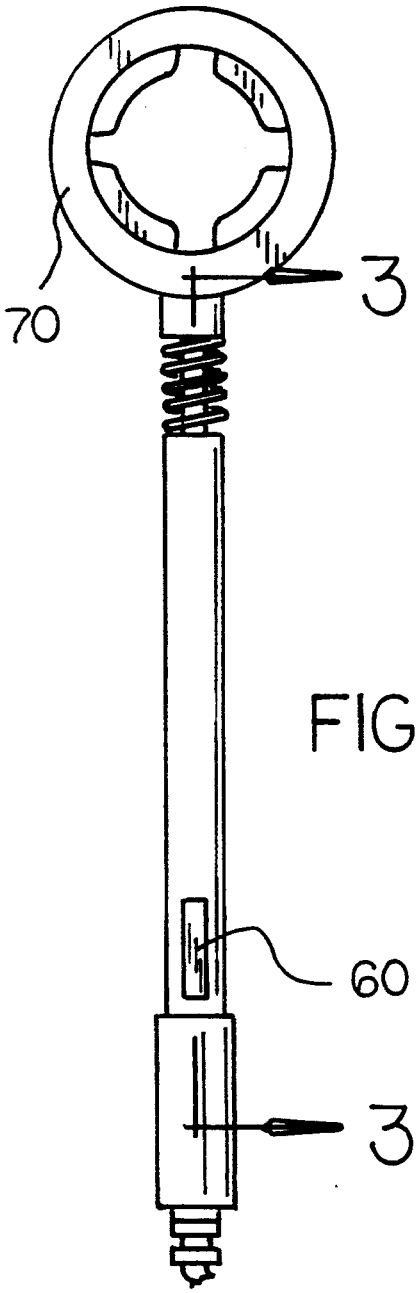
FIG. 2 is a plan view of the present invention depicted in FIG. 1.
Figure 3:
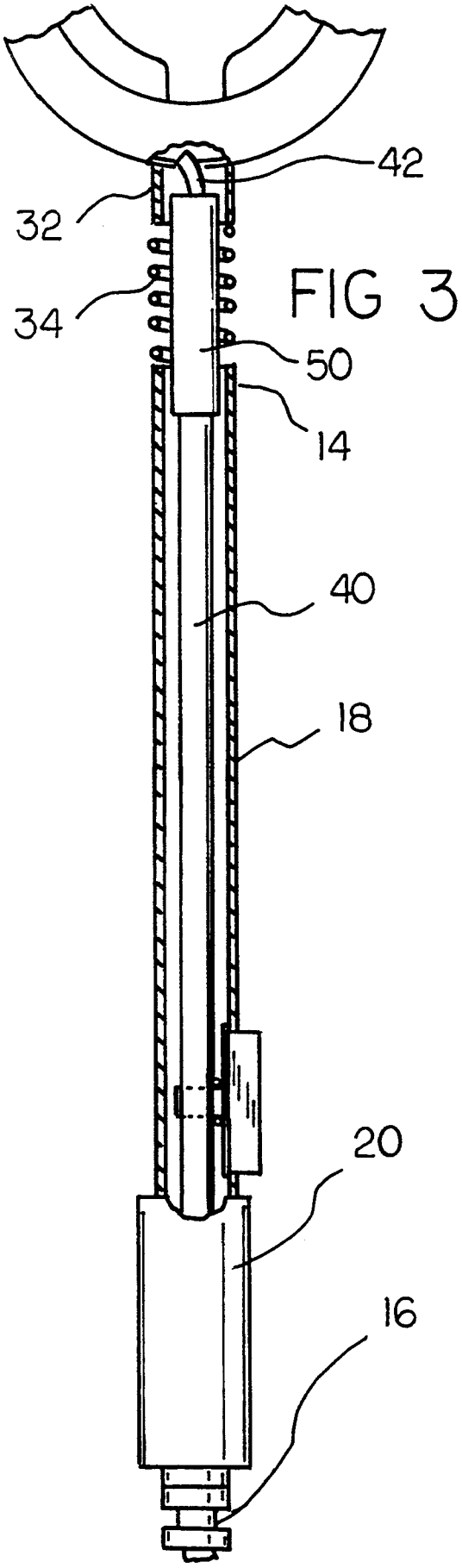
FIG. 3 is a view of the coupling between the handle, neck and head taken along the line 3—3 of FIG. 2.
Figure 4:
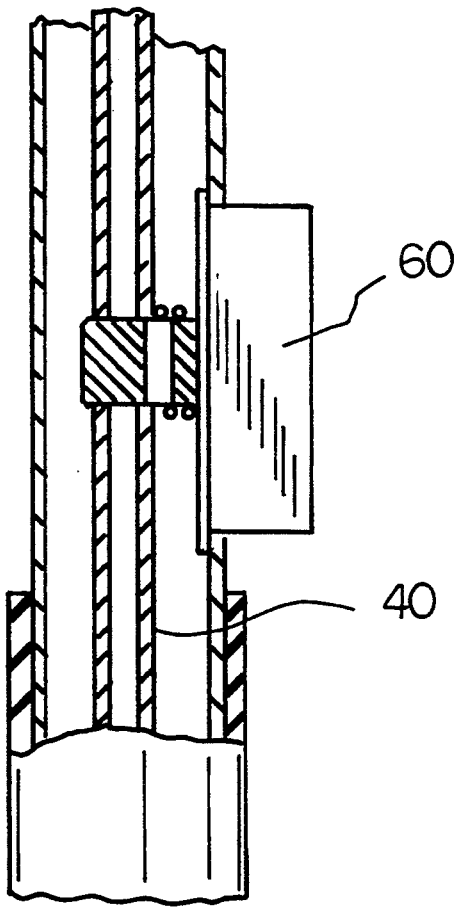
FIG. 4 is an enlarged view of the clamping means of FIG. 3.
Figure 5:
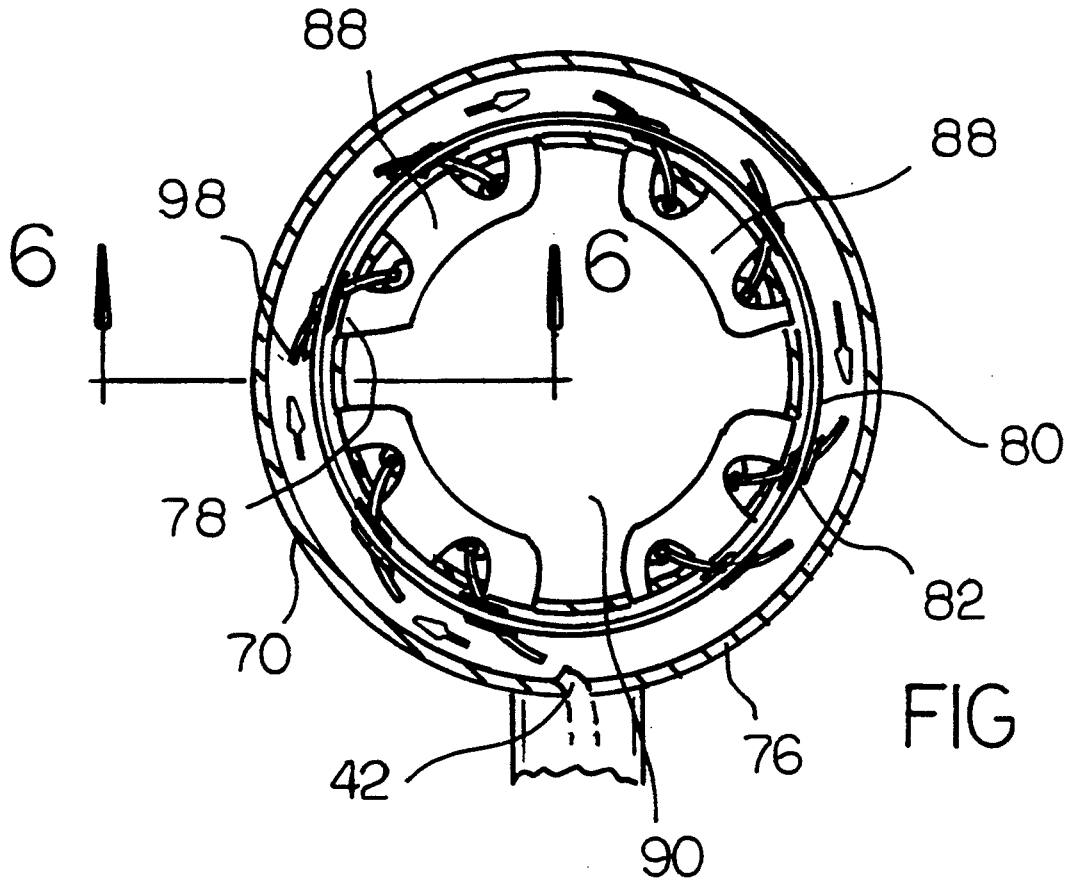
FIG. 5 is a view of the head taken along the line 5—5 of FIG. 1.
Figure 6:
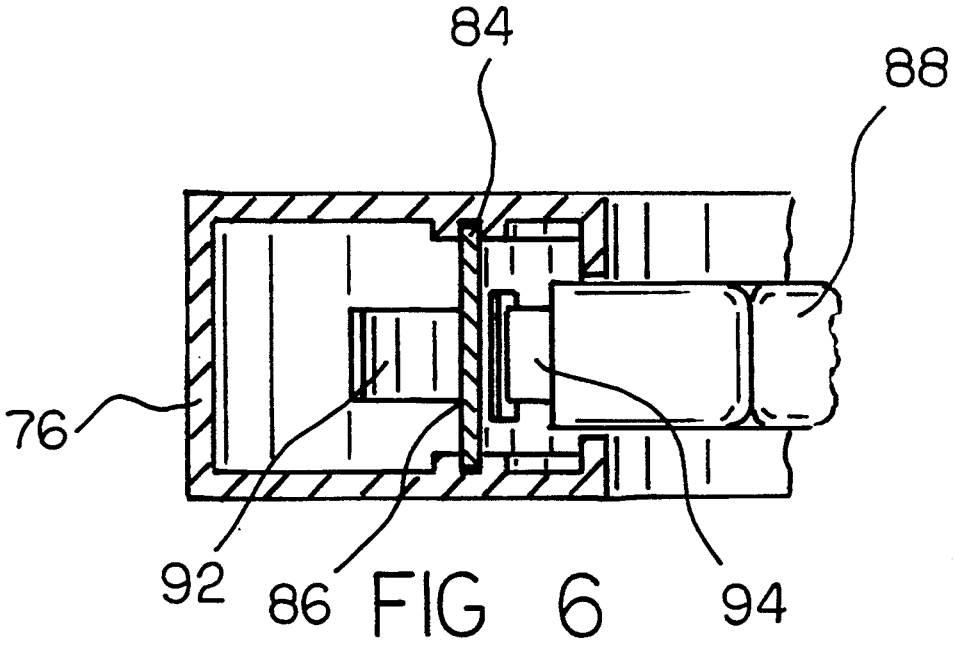
FIG. 6 is a view of the coupling between a gripper, vane, and housing taken along the line 6—6 of FIG. 5.
Figure 7:
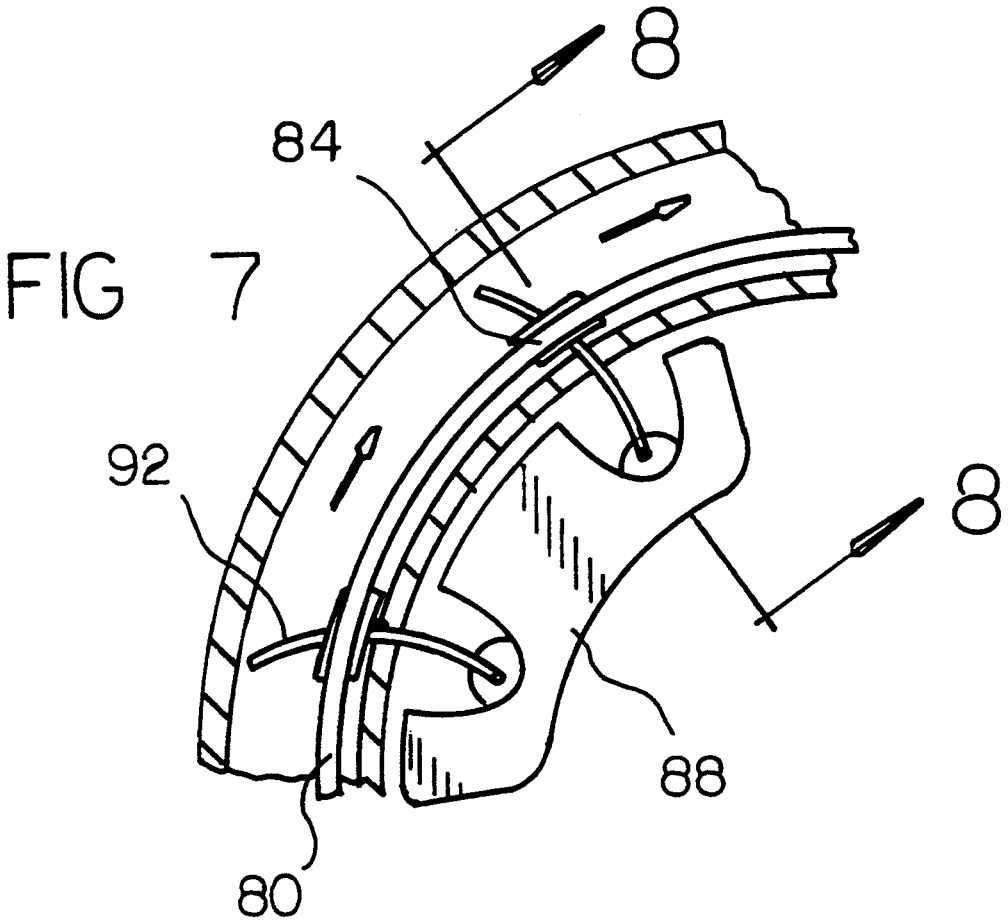
FIG. 7 is an enlarged view of a vane extended with the gripper projected radially inward. The grippers are extended radially inward due to pneumatic pressure directed on the vanes of the head.
Figure 8:
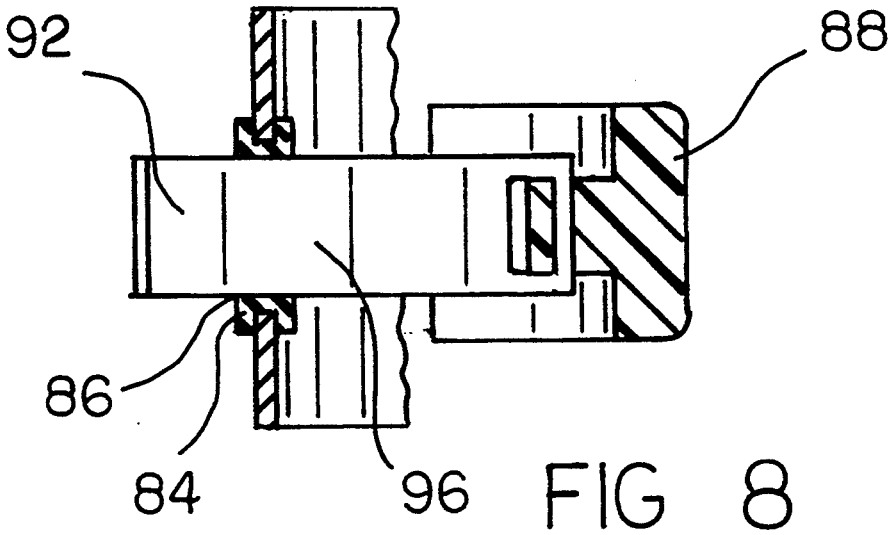
FIG. 8 is a view of the coupling between the vane, gripper and head taken along the line 8—8 of FIG. 7. The gripper is extended radially inward due to pneumatic pressure directed on the vanes of the head.

With reference now to the drawings, and in particular, to FIG. 1 thereof, the preferred embodiment of the new and improved automatic oil filter changer embodying the principles and concepts of the present invention and generally designated by the reference number 10 will be described.

Specifically, the present invention includes six major components. The major components are the handle, the neck, the tube, the shield, the clamping means, and the head. These components are interrelated to provide the intended function.

More specifically, it will be noted in the various Figures that the first major component is the handle 12. The handle is rigid and tubular in structure. The handle has a tip end 14, a base end 16, and an intermediate portion 18 extended therebetween. The base end of the handle has a grip 20 formed thereon. The grip is adapted for providing a user a firm hold of the handle.

The second major component is the neck 30. The neck has a collar 32. The collar has an upper portion and a lower portion. The neck also includes a spring 34. The spring has one end connected to the lower portion of the collar and the other end connected to the tip end 14 of the handle. The spring allows angular displacement of the handle 12 relative to the neck. This allows the handle to be maneuvered within an engine compartment.

The third major component is the tube 40. The tube is flexible in structure. The tube has a first end 42 extended through the handle 12 and neck 30. The tube projects from the upper end of the collar 32. The tube includes a second end 44. The second end is adapted to be coupled to a compressor. The tube is adapted to deliver pneumatic pressure from the compressor through the first end thereof.

The fourth major component is the shield 50. The shield is flexible and tubular in structure. The shield is disposed around the tube 40 and within the spring 34 of the neck with an upper portion extending into the collar and a lower portion extending into the handle. The shield protects the tube from being crimped when the handle 12 is angularly displaced relative to the neck.

The fifth major component is the clamping means 60. The clamping means is coupled to the intermediate portion 18 of the handle and the tube 40. The clamping means has a closed orientation for crimping the tube, thus preventing pneumatic pressure from being delivered through the first end 42. The clamping means also has an open orientation for allowing pneumatic pressure to be delivered through the first end.

The sixth major component is the head 70. The head is adapted to hold, thread, and unthread a cylindrically-shaped oil filter 72 from a vehicle 74 when the head is pneumatically energized. The head includes five sub-components. The sub-components are the housing, the ring, the sliders, the grippers, and the vanes.

The first sub-component is the housing 76. The housing is hollow and toroidal in structure. The housing has an inner radial extent and an outer radial extent. The outer radial extent is coupled to the upper portion of the collar 32 such that the first end of the tube 42 is extended within the housing. The inner radial extent has a first ringed aperture 78 disposed thereon allowing access into the housing.

The second sub-component is a ring 80. The ring is disposed within the housing. The ring further includes a second ringed aperture 82 disposed thereon.

The third sub-component is the sliders 84. A plurality of spaced sliders are disposed within the ringed aperture 82 and slidable therein. Each slider further has a hole 86 disposed therethrough.

The fourth sub-component is the grippers 88. A plurality of grippers are positioned around and adjacent to the inner radial extent of the housing 76. The grippers are projected inwards from the inner radial extent of the housing to define an opening 90. The opening is adapted to hold an oil filter 72 therein.

The fifth sub-component is the vanes 92. A plurality of curved vanes are included in the head. Each vane has a base end 94 pivotally coupled to a gripper 88. An intermediate portion 96 of the vane is connected to the base end and is extended radially outwards therefrom through the first ringed aperture 78 on the ring and through a hole 86 on a slider. A tip end 98 is coupled to the intermediate portion remote from the base end. The tip end is formed with an extended surface thereon adapted for receiving pneumatic pressure that is circularly directed through the housing from the first end of the tube 42. When the clamping means 60 is placed in an open orientation, pressure flows within the toroidal housing. The pressure is directed on the extended surfaces of the vanes, causing the vanes to be pivoted radially outward, whereby projecting the grippers 88 radially inward. This action allows the grippers to hold and rotate an oil filter 72 placed in the opening 90, thus enabling an oil filter to be screwed or unscrewed from a vehicle 74. When the clamping means is placed in a closed orientation, pneumatic pressure is prevented from entering the housing. Spring action due to the curvature of the vanes causes the vanes to pivot radially inward, whereby projecting the grippers radially outward, thus allowing the grippers to release an oil filter held therebetween.

In the preferred embodiment, the present invention is pneumatically powered. The present invention grips the oil filter and rotates it until it disengages from the engine block of a vehicle. The present invention can also be used to tighten an oil filter to the engine block of a vehicle by simply rotating the head 180 degrees about a central axis defined through the neck. The handle is long and flexible to allow it to snake into an area of an engine compartment to access the oil filter. The toroidal housing is placed over the filter and pressure is applied via the clamping means to allow the grippers to grip the oil filter therein. By activating and deactivating the clamping means in a switched operation, the oil filter is slowly rotated until it has been installed or removed. The grippers also allow the filter to be held in place when being removed from the car. The filter is not dropped from the housing until the clamping means is deactivated. The elongated handle allows the oil filter to be readily accessed, thus minimizing the probability of a mechanic burning his hands on a hot engine. The device can be run by compressed air or can be energized electrically with a motor coupled to the housing. The major components of the present invention are made of plastic or steel, preferably aluminum because of its light weight. The present invention is adapted to be utilized by professional mechanics and personnel working in quick oil change centers.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by letters patent of the United States is as follows:

1. An automatic oil filter changer for changing the oil filter on a vehicle comprising, in combination:

a rigid and tubular handle having a tip end, a base end, and an intermediate portion extended therebetween, the base end having a grip formed thereon adapted for providing a user a firm hold thereof;

a neck having a collar with an upper portion and a lower portion and a spring having one end connected to the lower portion of the collar and the other end connected to the tip end of the handle, the spring allowing angular displacement of the handle relative to the neck;

a flexible tube having a first end extended through the handle and neck to project from the upper end of the collar and a second end adapted to be coupled to a compressor, the tube adapted to deliver pneumatic pressure from the compressor through the first end thereof;

a flexible and tubular shield disposed around the tube and within the spring of the neck for protecting the tube from being crimped when the handle is angularly displaced relative to the neck;

clamping means coupled to the intermediate portion of the handle and the tube, the clamping means having a closed orientation for crimping the tube for preventing pneumatic pressure from being delivered through the first end and an opened orientation for allowing pneumatic pressure to be delivered through the first end; and a head adapted to hold, thread, and unthread an oil filter from a vehicle when pneumatically energized, the head further comprising:

a hollow and toroidal housing having an inner radial extent and an outer radial extent, the outer radial extent coupled to the upper portion of the collar such that the first end of the tube is extended within the housing, the inner radial extent having a first ringed aperture disposed thereon;

a ring disposed within the housing having a second ringed aperture disposed thereon;

a plurality of spaced sliders disposed and slidable in the second ringed aperture, each slider further having a hole disposed therethrough;

a plurality of grippers positioned around and adjacent to the inner radial extent of the housing and projected inwards therefrom to define an opening adapted to hold an oil filter therein; and a plurality of curved vanes, each vane having a base end pivotally coupled to a gripper, an intermediate portion connected to the base end and extending radially outwards therefrom through the first ringed aperture and through a hole on a slider, and a tip end coupled to the intermediate portion remote from the base end and formed with an extended surface adapted for receiving pneumatic pressure circularly directed through the housing from the first end of the tube such that when the clamping means is placed in an opened orientation, the vanes are pivoted radially outward and project the grippers radially inward, whereby allowing the grippers to hold and rotate an oil filter therebetween, thus enabling an oil filter to be unscrewed or unscrewed from a vehicle, and when the clamping means is placed in a closed orientation, the vanes are pivoted radially inward and project the grippers radially outward, whereby allowing the grippers to release an oil filter held therebetween.

2. An automatic oil filter changer for changing the oil filter on a vehicle comprising, in combination:

an elongated handle;

a tube for delivering pressure having a first end and a second end, the second end adapted to be coupled to a pressure delivery mechanism;

clamping means coupled to the handle and tube, the clamping means having a closed orientation for crimping the tube for preventing pressure from being delivered through the first end and an opened orientation for allowing pressure to be delivered through the first end; and head means coupled to the handle and first end of the tube, the head means adapted to receive an oil filter therein, the head means further adapted to receive pressure from the first end of the tube such that when the clamping means is placed in an opened orientation, the head means grips and rotates an oil filter positioned therein, and when the clamping means is placed in a closed orientation, the head means releases its grip of the oil filter.

3. The device as set forth in claim 2 wherein the head means is rotatable with respect to the handle.

* * * * *